US010648067B2

(12) United States Patent
Damschroder et al.

(10) Patent No.: US 10,648,067 B2
(45) Date of Patent: May 12, 2020

(54) PRECIPITATION STRENGTHENED METAL ALLOY ARTICLE

(71) Applicant: Materion Corporation, Mayfield Heights, OH (US)

(72) Inventors: Christopher Damschroder, Elmore, OH (US); W. Raymond Cribb, Westerville, OH (US)

(73) Assignee: MATERION CORPORATION, Mayfield Heights, OH (US)

( * ) Notice: Subject to any disclaimer, the term of this patent is extended or adjusted under 35 U.S.C. 154(b) by 45 days.

(21) Appl. No.: 15/843,496

(22) Filed: Dec. 15, 2017

(65) Prior Publication Data

US 2018/0171455 A1 Jun. 21, 2018

Related U.S. Application Data

(60) Provisional application No. 62/434,582, filed on Dec. 15, 2016.

(51) Int. Cl.

| | |
|---|---|
| ***C22F 1/08*** | (2006.01) |
| ***C22C 9/00*** | (2006.01) |
| ***C22F 1/10*** | (2006.01) |
| ***C21D 6/02*** | (2006.01) |
| ***C22F 1/18*** | (2006.01) |
| ***C22F 1/04*** | (2006.01) |
| ***C22C 9/06*** | (2006.01) |

(52) U.S. Cl.

CPC ..... *C22F 1/08* (2013.01); *C21D 6/02* (2013.01); *C22C 9/00* (2013.01); *C22C 9/06* (2013.01); *C22F 1/04* (2013.01); *C22F 1/10* (2013.01); *C22F 1/183* (2013.01)

(58) Field of Classification Search

CPC .... C22C 9/00; C22C 9/02; C22C 9/06; C22C 14/00; C22C 19/00; C21D 6/00; C21D 8/00; C22F 1/08

See application file for complete search history.

(56) References Cited

U.S. PATENT DOCUMENTS

| | | | | |
|---|---|---|---|---|
| 4,599,120 | A * | 7/1986 | Church | C22F 1/08 148/414 |
| 9,994,946 | B2 * | 6/2018 | Cribb | C22F 1/08 |
| 2010/0329923 | A1 | 12/2010 | Muramatsu | |
| 2011/0067788 | A1 * | 3/2011 | Swiatek | C21D 6/00 148/645 |
| 2014/0238198 | A1 * | 8/2014 | Tunison | C22B 13/06 75/697 |
| 2014/0311633 | A1 | 10/2014 | Cribb | |

OTHER PUBLICATIONS

Partial International Search Report for PCT Application No. PCT/US2017/066642 dated Mar. 22, 2018.

* cited by examiner

*Primary Examiner* — Mark Kopec
(74) *Attorney, Agent, or Firm* — Fay Sharpe LLP

(57) ABSTRACT

A metal alloy article having a combination of mechanical properties which are uniform across a cross-sectional area of the article is disclosed. The metal alloy is a precipitation hardenable alloy, such as an aluminum, copper, nickel, iron, or titanium alloy. In specific embodiments, the metal alloy is a copper-nickel-tin alloy with a nominal composition of Cu—15Ni—8Sn. The article is strengthened by process treatment steps including solution annealing, cold working, and precipitation hardening. The article has a constant cross-section along a length thereof with a minimum 0.2% offset yield strength of about 70 ksi.

11 Claims, 6 Drawing Sheets

PRECIPITATION STRENGTHENED METAL ALLOY ARTICLE

CROSS-REFERENCE TO RELATED APPLICATIONS

This application claims priority to U.S. Provisional Patent Application Ser. No. 62/434,582, filed on Dec. 15, 2016, the entirety of which is incorporated by reference herein.

BACKGROUND

The present disclosure relates to articles, such as large diameter rods and tubes, for example, that have mechanical property combinations of yield strength in excess of 70 ksi and very high and uniform impact toughness. It finds particular application in conjunction with articles made from precipitation hardened alloys, such as alloys comprising copper, nickel, and tin, and will be described with particular reference thereto. However, it is to be appreciated that the present disclosure is also amenable to other like applications with other precipitation hardenable alloys.

BRIEF DESCRIPTION

In accordance with one aspect of the present disclosure, methods of strengthening a metal alloy article derived from a cast or wrought input are disclosed. Principally, solution annealing will be performed until the input reaches a uniform temperature throughout. Next, cold working is performed on the input to achieve a desired shape and size, such as an input having a relatively constant cross-section along its length. For example, the input can be a cylinder having a diameter of at least 3.25 inches and a length of at least 30 feet. The input can then be heat treated to obtain an article having a uniform toughness and a uniform yield strength across the cross-section of the article.

In accordance with another aspect of the present disclosure, a metal alloy article derived from a metal input is disclosed. The alloy is a precipitation hardenable metal alloy, for example an alloy containing copper in combination with nickel and tin. The article has a relatively constant cross-section along a length of the article. The metal alloy article has uniform mechanical properties across the cross-section of the article.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1A:
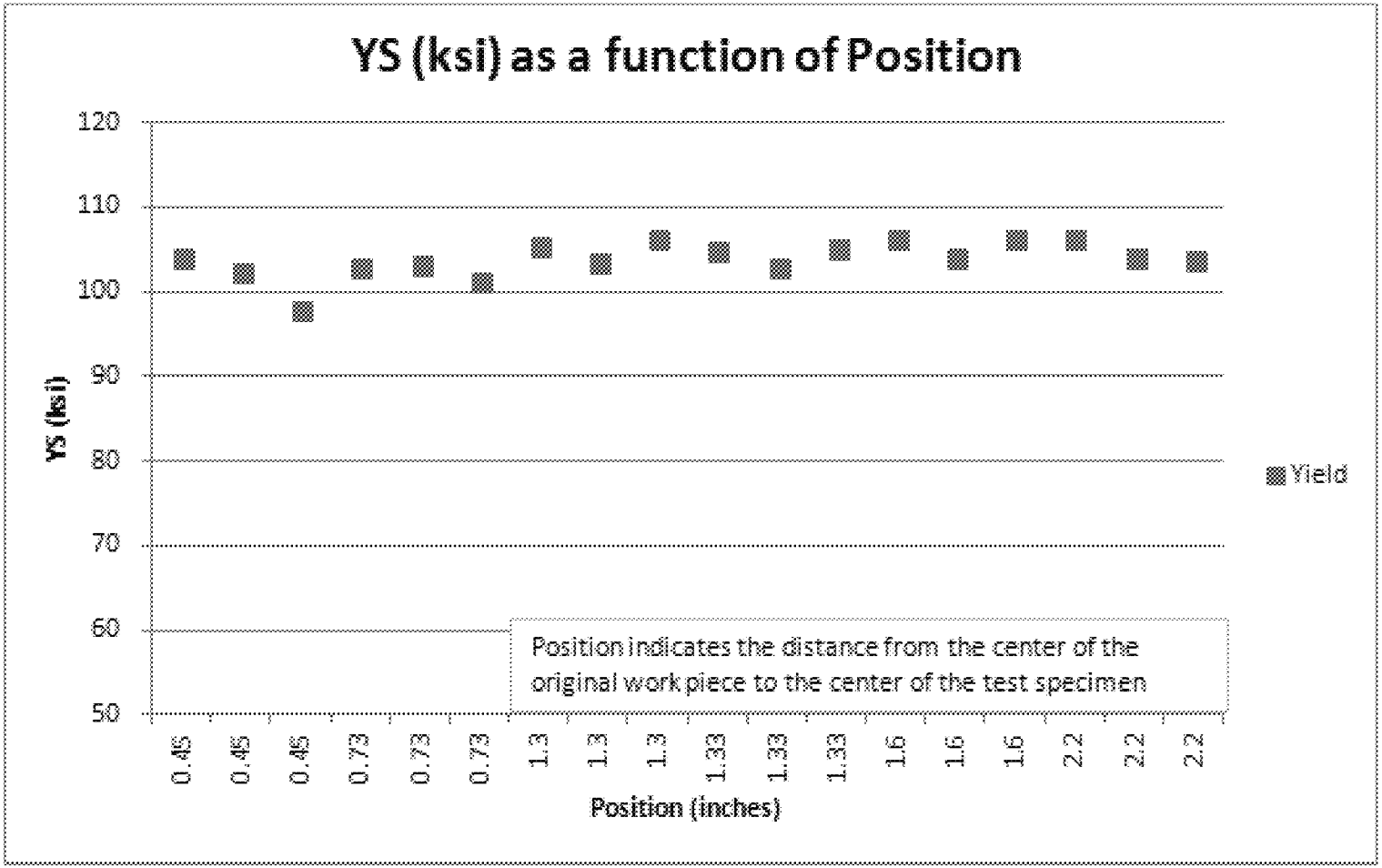
FIG. 1A is a graph showing 0.2% offset yield strength (YS) as a function of position for a finished metal alloy rod having a nominal diameter of 5 inches made according to the methods/processes of the present disclosure.

The present disclosure may be understood more readily by reference to the following detailed description of desired embodiments and the examples included therein. In the following specification and the claims which follow, reference will be made to a number of terms which shall be defined to have the following meanings.

The singular forms "a," "an," and "the" include plural referents unless the context clearly dictates otherwise.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

As used herein, approximating language, such as "about" and "substantially," may be applied to modify any quantitative representation that may vary without resulting in a change in the basic function to which it is related. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number.

The term "room temperature" refers to a range of from 20° C. to 25° C.

The term "uniform" is used to describe the mechanical properties of an article, such as the 0.2% offset yield strength, hardness, or toughness. When used to describe mechanical properties, the term "uniform" refers to consistency of measured property values between varying positions across the article cross-section. Measured property values are still considered "uniform" when minor deviations exist between different positions. For purposes of the present disclosure, a uniform 0.2% offset yield strength is obtained if all values are ±5 ksi in either direction from the average value. Uniform Rockwell hardness on the B or C scales is obtained if all measured values are ±2 HRB or HRC in either direction from the average value. Finally, uniform impact toughness is obtained if all values are ±10 ft-lbs in either direction from the average value. Please note that these are absolute values, not standard deviation.

As used herein, the terms "precipitation hardening" and "age hardening" are interchangeable. In this regard, not all alloys are spinodally hardenable, but all spinodally hardenable alloys are precipitation or age hardenable, for example.

The present disclosure provides methods of manufacturing and strengthening a metal alloy article, such as a rod or a tube-like cylinder. The article can be derived from a casting or a wrought shape. The disclosed methods advantageously allow for the making of articles such as rods having a cross-section diameter in excess of at least 3.25 inches, while still maintaining a combination of mechanical properties which are desirably uniform across the cross-section diameter. In prior manufacturing and strengthening processes, metal alloy rods having diameters in excess of about 3.25 inches were not successful in achieving such a combination of uniform mechanical properties. The present disclosure may particularly refer to articles having a rod or tube-like cylinder shape. However, the methods/processes described herein will apply to any article having a constant cross-section along its length, such as a bar, plate, "L" shape, star shape, "X" shape, etc.

The length along which the constant cross-section is present does not have to be equal to the length of the entire article. For example, the article may have portions with different cross-sectional sizes. For example, a dog-bone shaped article is contemplated where the end portions of the article have a larger outer diameter and the central portion has a smaller outer diameter than the larger outer diameter of the end portions. In such an example, the smaller diameter central portion may exhibit enhanced mechanical properties relative to the larger outer diameter end portions, due to concentrated uniform cold-work in the smaller diameter central portion.

Initially, the alloy articles are derived from an input. The input can be a billet or a workpiece. In this regard, it should be noted that the term "alloy" refers to the material itself, while the term "input" refers to the solidified structure made from the molten alloy and which is processed according to the methods of the present disclosure. The term "billet" is used to refer to a continuous or static casting, which has not been previously worked (i.e. virgin). A "workpiece" refers to a billet that has subsequently been mechanically shaped. A "rod" is solid, while a "tube" has a hollow passageway through its length. The term "input" is also used to refer to the initial metal piece that enters the processes of the present disclosure, while the term "article" is used to refer to the final metal piece that exits, or is obtained from, the processes of the present disclosure.

The metal alloy used to make the disclosed articles can be a copper based alloy. Alternatively, the metal alloy used to make the disclosed articles can be an aluminum (Al), nickel (Ni), iron (Fe), or titanium (Ti) alloy. An alloy has more than 50 wt % of the listed element.

For example, a precipitation hardenable copper-nickel-tin (CuNiSn) alloy can be used. The copper-nickel-tin alloys disclosed herein comprise from about 5 wt % to about 20 wt % nickel, from about 5 wt % to about 10 wt % tin, and the remainder copper. More preferably, the copper-nickel-tin alloys comprise from about 14 wt % to about 16 wt % nickel, including about 15 wt % nickel; and from about 7 wt % to about 9 wt % tin, including about 8 wt % tin; and the balance copper, excluding impurities and minor additions. In yet other preferred embodiments, the copper-nickel-tin alloys comprise from about 8 wt % to about 10 wt % nickel and from about 5 wt % to about 7 wt % tin; and the balance copper, excluding impurities and minor additions. Minor additions include boron, zirconium, iron, and niobium, which further enhance the formation of equiaxed crystals and also diminish the dissimilarity of the diffusion rates of Ni and Sn in the matrix during solution heat treatment. Other minor additions include magnesium and manganese which can serve as deoxidizers and/or can have an impact on mechanical properties of the alloy in its finished condition. Other elements may also be present. Impurities include beryllium, cobalt, silicon, aluminum, zinc, chromium, lead, gallium or titanium. For purposes of this disclosure, amounts of less than 0.01 wt % of these elements should be considered to be unavoidable impurities, i.e. their presence is not intended or desired. Not more than about 0.3% by weight of each of the foregoing elements is present in the copper-nickel-tin alloys.

In some embodiments, the copper alloy is a CuproNickel alloy, which is also known as CA717 or UNS C71700 alloy. UNS C71700 alloys contain up to 1.0 wt % zinc, about 0.40 wt % to about 1.0 wt % iron, about 29 wt % to about 33 wt % nickel, about 0.3 to about 0.7 wt % beryllium (Be), up to 1.0 wt % manganese, and balance copper.

In other embodiments, the copper alloy also contains beryllium (i.e. a BeCu alloy). In some embodiments, the BeCu alloy generally comprises about 1.6 wt % to about 2.0 wt % beryllium, including from about 1.8 wt % to about 2.0 wt % and from about 1.8 wt % to about 1.9 wt % beryllium. These BeCu alloys can also include cobalt (Co), nickel (Ni), iron (Fe), and/or lead (Pb). In some embodiments, the BeCu alloy may further comprise from about 0.2 wt % to about 0.3 wt % cobalt. In still other embodiments, from about 0.2 wt % to about 0.6 wt % lead may be included in the BeCu alloy. These listed amounts for each element can be combined with each other in any combination.

In other embodiments, the sum of cobalt and nickel in these BeCu alloys is at least 0.2 wt %. In other embodiments, the sum of cobalt, nickel, and iron in the BeCu alloy is at most 0.6 wt %. It should be noted that this does not require all three elements to be present. Such alloys could contain at least one of nickel or cobalt, but could potentially contain only nickel or cobalt. The presence of iron is not required, but in some particular embodiments iron is present in an amount of about 0.1 wt % or more (up to the stated lim it).

In some particular embodiments, the BeCu alloy comprises about 1.8 wt % to about 2.0 wt % beryllium; a sum of cobalt and nickel of at least 0.2 wt %; a sum of cobalt, nickel, and iron of at most 0.6 wt %; and balance copper. This alloy is commercially available from Materion Corporation as Alloy 25, Alloy 190, or Alloy 290, and is also known as UNS C17200 alloy.

In some particular embodiments, the BeCu alloy comprises about 1.6 wt % to about 1.85 wt % beryllium; a sum of cobalt and nickel of at least 0.2 wt %; a sum of cobalt, nickel, and iron of at most 0.6 wt %; and balance copper. This alloy is commercially available from Materion Corporation as Alloy 165, and is also known as UNS C17000 alloy.

In other embodiments, the BeCu alloy comprises about 1.8 wt % to about 2.0 wt % beryllium; about 0.2 wt % to about 0.3 wt % cobalt; and balance copper. This alloy is commercially available from Materion Corporation as MoldMax HH® or MoldMax LH®, and may be considered to be a UNS C17200 alloy.

In other particular embodiments, the BeCu alloy comprises about 1.8 wt % to about 2.0 wt % beryllium; a sum of cobalt and nickel of at least 0.2 wt %; a sum of cobalt, nickel, and iron of at most 0.6 wt %; from about 0.2 wt % to about 0.6 wt % lead; and balance copper. This alloy is commercially available from Materion Corporation as Alloy M25, and is also known as UNS C17300 alloy.

In some other embodiments, the BeCu alloy generally comprises about 0.2 wt % to about 0.7 wt % beryllium, including from about 0.2 wt % to about 0.6 wt % or from about 0.4 wt % to about 0.7 wt % beryllium. These BeCu alloys can also include cobalt (Co) or nickel (Ni). In some embodiments, the BeCu alloy may further comprise from about 0.8 wt % to about 2.7 wt % cobalt, including from about 0.8 wt % to about 1.3 wt % or from about 2.4 wt % to about 2.7 wt % cobalt. In some embodiments, the BeCu alloy may further comprise from about 0.8 wt % to about 2.2 wt % nickel, including from about 0.8 wt % to about 1.3 wt % or from about 1.4 wt % to about 2.2 wt % nickel. These listed amounts for each element can be combined with each other in any combination.

In some particular embodiments, the BeCu alloy comprises about 0.2 wt % to about 0.6 wt % beryllium; about 1.4 wt % to about 2.2 wt % nickel; and balance copper. This alloy is commercially available from Materion Corporation as Alloy 3, and is also known as UNS C17510 alloy.

In some particular embodiments, the BeCu alloy comprises about 0.4 wt % to about 0.7 wt % beryllium; about 2.4 wt % to about 2.7 wt % cobalt; and balance copper. This alloy is commercially available from Materion Corporation as Alloy 10, and is also known as UNS C17500 alloy.

In yet other alternative embodiments, the copper alloy is a copper-nickel-silicon-chromium (Cu—Ni—Si—Cr) alloy. The amount of nickel in the Cu—Ni—Si—Cr alloy may be from about 5 wt % to about 9 wt % of the alloy, including from about 6 wt % to about 8 wt %; or from about 6.4 wt % to about 7.6 wt % nickel. The amount of silicon in the Cu—Ni—Si—Cr alloy may be from about 1 wt % to about 3 wt % of the alloy, including from about 1.5 wt % to about 2.5 wt % silicon. The amount of chromium in the Cu—Ni—Si—Cr alloy may be from about 0.2 wt % to about 2.0 wt % of the alloy, including from about 0.3 wt % to about 1.5 wt %; or from about 0.6 wt % to about 1.2 wt % chromium. The balance of the alloy is copper. These listed amounts of copper, nickel, silicon, and chromium may be combined with each other in any combination.

In still more specific embodiments, the copper-nickel-silicon-chromium alloy contains: about 6.4 wt % to about 7.6 wt % nickel; about 1.5 wt % to about 2.5 wt % silicon; about 0.6 wt % to about 1.2 wt % chromium; and balance copper. This alloy is commercially available from Materion Corporation as MoldMax V® or PerforMet™.

The alloy articles, after the processing steps described herein, have a 0.2% offset yield strength of at least 70,000 psi (i.e., 70 ksi) to about 180 ksi. The 0.2% offset yield strength is measured according to ASTM E8-16a. The alloy articles also have an impact toughness of at least 25 foot-pounds (ft-lbs) to about 100 ft-lbs when measured according to ASTM E23-16b, using a Charpy V-notch test at room temperature. The alloy articles also have a hardness of at least about 90 HRB to about 100 HRB, or a hardness of at least about 20 HRC to about 40 HRC. The Rockwell hardness is measured according to ASTM E18-17e1.

The mechanical property combinations achieved according to the disclosed methods include uniform impact toughness, hardness, and yield strength throughout a cross-sectional area of the final metal alloy article. These properties are possible through the use of thermal strengthening mechanisms. For example, in some embodiments, the process includes the overall steps of vertical continuous casting, homogenization, hot working, solution annealing, cold working, and precipitation hardening. As another example according to embodiments disclosed herein, the process includes the overall steps of casting, homogenization, solution annealing, cold working, and a precipitation hardening treatment. In another exemplary non-limiting embodiment, at least three strengthening process steps are critical, including solution annealing, cold working, and precipitation hardening. It is contemplated that the resulting article produced from alloys strengthened through the aforementioned processes can be rods/tubes that have a diameter of up to at least 10 inches, such as those used in the oil and gas industries industrial machined bearings, as well as other symmetrical shapes including rods, bars and plates. In further non-limiting embodiments, the resulting article can be a rod/tube produced from alloys strengthened through the aforementioned processes and having a diameter of from about 1 inch to about 10 inches.

The processes of the present disclosure are performed upon an input, which can be a billet or a workpiece. A billet having a fine and largely unitary grain structure can be formed by casting, such as by vertically continuous casting. Depending on the desired application, the billet can be a slab or a blank, and in some embodiments has a cylindrical or other shape. The casting process advantageously enables hot working processes and extends the mechanical property combination options to meet application needs such as aerospace, oil and gas exploration components, and tribologic parts for mechanical systems and machinery, for example. Alternatively, the input can be a pre-forged, wrought shape (also known as a hot-worked product or workpiece).

The input and the final article have a constant cross-section, as discussed above. The "cross-section" refers to the shape of the input/article along a plane that is normal to the length of the input/article. The cross-section geometry or shape is "constant" if the length of a reference line (e.g. "diameter") drawn between opposite sides of the perimeter of the cross-section does not vary by more ±5% in either direction from the average value of that line, as determined by multiple measurements taken along the length of the input/article.

The thermal strengthening process can include subjecting the input to a first heat treatment or homogenization step. The heat treatment is performed at a sufficient temperature for a sufficient length of time to transform the matrix of the alloy to a single phase (or very nearly to a single phase). In other words, the input is heat treated to homogenize the alloy. Depending upon the final mechanical properties desired and the alloy, the temperature and the period of time to which the input is heat treated can be varied. In embodiments, for copper alloys, this homogenization heat treatment is performed at a temperature of about 1350° F. or higher, including a range of from about 1475° F. to about 1650° F. For aluminum alloys, the homogenization temperature may be from about 840° F. to about 1070° F. For titanium alloys, the homogenization temperature may be from about 800° F. to about 1050° F. For iron alloys, the homogenization temperature may be from about 1700° F. to about 1950° F. For nickel alloys, the homogenization temperature may be from about 1800° F. to about 2450° F. The homogenization may occur for a time period of from about 4 hours to about 48 hours.

The thermal strengthening process can also include subjecting the homogenized input to hot working. Here, the input is subjected to significant uniform mechanical deformation that reduces the cross-sectional area of the input, or substantially changes the shape of the original input. The hot working can occur between the solvus and the solidus temperatures, permitting the alloy to recrystallize during deformation. This changes the microstructure of the alloy to form finer grains that can increase the strength, ductility, and hardness of the material. The hot working may result in the alloy having anisotropic properties or not, depending on the hot working schedule. The hot working can be performed by hot forging, hot extrusion, hot rolling, hot piercing (i.e. rotary piercing) or other hot working processes. During the hot working, the input may be reheated for about one hour per inch thickness of the input, but in any event for at least long enough to assure temperature uniformity. In some embodiments, this is about 6 hours.

For metals such as precipitation hardenable copper alloys, the thermal strengthening process for the input generally begins with a heat treatment such as solution annealing. In other words, in some embodiments, solution annealing is performed after the homogenization step described above and no intermediate hot working is performed (e.g., for billets derived directly from a casting). In other non-limiting embodiments, solution annealing is performed after the hot working step described above. During solution annealing, the metal input is heated to a temperature high enough to cause all of the alloying elements to diffuse evenly into the major element of the alloy. Solution annealing can be performed on the input until it reaches a uniform temperature throughout. In embodiments for copper alloys, the solution annealing is performed at a temperature of about 1300° F. or higher, including a range of from about 1350° F. to about 1650° F. or from about 1300° F. to about 1700° F. for copper alloys. The solution annealing is performed for a period of time of about 60 seconds to about 5 hours, including about 3 hours or longer.

For aluminum alloys, the solution annealing temperature may be from about 840° F. to about 1070° F. For titanium alloys, the solution annealing temperature may be from about 800° F. to about 1050° F. For iron alloys, the solution annealing temperature may be from about 1700° F. to about 1950° F. For nickel alloys, the solution annealing temperature may be from about 1800° F. to about 2450° F. The solution annealing is also performed for a period of time of about 60 seconds to about 5 hours, including about 3 hours or longer, for these alloys. It is noted that the solution annealing temperature is usually lower than the homogenization temperature, and the solution annealing time is also usually shorter than the time for the homogenization described above.

Generally, an immediate cold water quench of the input is carried out after the solution annealing treatment. The water temperature used for the quench is at 180° F. or less. Quenching provides a means of preserving as much of the dissolved elements in the structure obtained from the solution annealing treatment as possible. Minimizing the time interval from removal of the input from the heat treating furnace until the start of the quench is important. For example, any delay greater than 2 minutes between removal of the input from the solution heat treatment furnace and quench is deleterious. The input should be held in the quench for at least thirty (30) minutes to reduce the interior temperature to about 500° F. or less. Air or other controlled cooling may also be acceptable as a substitute for the quenching.

Next, the solution annealed input is cold worked, or put another way cold working is performed upon the solution annealed input. The input can be a casting or prior hot worked rod, tube, or plate, for example. The input is usually "soft" and more tolerant to cold working or forming after the solution treatment. Cold working is the process of altering the shape or size of the metal input by plastic deformation and can include rolling, drawing, pilgering, pressing, spinning, extruding, or heading of the metal input.

Cold working is generally performed at a temperature below the recrystallization point of the input and is usually done at room temperature. Cold working increases hardness and tensile strength while generally reducing ductility and impact characteristics. Cold working can also improve the surface finish of the input. The process is categorized herein as a percentage of reduction of cross-sectional area as a result of plastic deformation. This reduces microsegregation by mechanically reducing secondary inter-dendritic distances in the input workpiece. Cold working also increases the yield strength of the input. For an optimum value of high strength achievable by a combination of cold work and precipitation hardening, a reduction in cross-sectional area of at least 20% should occur. However, any suitable reduction in cross-sectional area by cold working can be performed depending on the desired mechanical properties. For example, a reduction in cross-sectional area of about 5% to about 40% or more can be performed by cold working. The degree of reduction is measured according to the following formula:

$$\% \text{ CW}=100*[A_0-A_f]/A_0$$

where $A_0$ is the initial or original cross-sectional area before cold working, and $A_f$ is the final cross-sectional area after cold working. These cold working parameters are applicable to copper alloys as well as aluminum (Al), nickel (Ni), iron (Fe), or titanium (Ti) alloys.

The solution annealing and cold working steps can be repeated until the desired size or other parameters are produced. In embodiments, cold working is performed on the input until the input has a diameter of at least 3.25 inches and a length of up to about 30 feet or more. In further embodiments, diameters of from about 1 inch to about 10 inches are contemplated. Cold working must directly precede precipitation hardening.

The cold worked input, whether derived directly from a casting or from a wrought shape, is then subjected to an additional heat treatment or precipitation hardening. This heat treatment acts to age harden the input. Generally speaking, the precipitation hardening occurs at a temperature within the spinodal or other precipitation region, which is a temperature below the solution annealing temperature. In embodiments, for copper alloys such as CuNiSn, this temperature is between about 400° F. and about 1000° F., including from about 475° F. to about 850° F., from about 475° F. to about 1000° F., and from about 500° F. to about 750° F. Here, the single phase material will spontaneously decompose into alternating areas of two chemically different but structurally identical phases. The structure in the precipitation hardened article is very fine, invisible to the eye, and continuous throughout the grains and up to the grain boundaries. Alloys strengthened by spinodal decomposition develop a characteristic modulated microstructure. Resolution of this fine scale structure is beyond the range of optical microscopy. It is only resolved by skillful electron microscopy. Alternatively, the satellite reflections around the fundamental Bragg reflections in the electron diffraction patterns have been observed to confirm spinodal decomposition occurring in copper-nickel-tin and other alloy systems. The temperature and the period of time to which the workpiece is heat treated can be varied to obtain the desired final properties. In embodiments, the precipitation hardening treatment is performed for a time period of from about 10 minutes to about 10 hours or more, including from about 3 hours to about 5 hours.

For aluminum alloys, the precipitation hardening treatment temperature may be from about 200° F. to about 500° F. For titanium alloys, the precipitation hardening treatment temperature may be from about 400° F. to about 650° F. For iron alloys, the precipitation hardening treatment temperature may be from about 900° F. to about 1150° F. For nickel alloys, the precipitation hardening treatment temperature may be from about 1000° F. to about 2080° F. The precipitation hardening treatment is also performed for a time period of from about 10 minutes to about 10 hours or more, including from about 3 hours to about 5 hours, for these alloys.

In particular embodiments, the diameter of the final article, which can be a rod/tube, is at least 3.25 inches.

In some particular embodiments for copper alloys, the solution annealing of the input occurs at a temperature of about 1500° F. for a period of time of about 3 hours; the cold working results in a reduction of cross-sectional area of the input of about 25% and a cross-section diameter of the input is at least 3.25 inches and the input has a length of up to about 30 feet; and the precipitation hardening occurs at a temperature of about 475° F. to about 850° F. for a period of time of about 10 minutes to about 10 hours.

In some further particular embodiments for copper alloys, the solution annealing of the input occurs at a temperature of about 1500° F. for a period of time of about 3 hours; the cold working results in a reduction of cross-sectional area of the input of about 25% and a cross-section diameter of the input is about 5 inches; and the precipitation hardening occurs at a temperature of about 475° F. to about 850° F. for a period of time of about 10 minutes to about 10 hours.

In particular embodiments for articles having large diameters and made of copper alloys, such as about 10 inches, the precipitation/spinodal hardening occurs at a temperature of from about 500° F. to about 750° F. for a period of time of about 3 hours to about 5 hours, followed by air cooling the article.

Utilizing the above described processes, an advantageous combination of mechanical properties for the resulting article is obtained for the metal alloys described herein. In particular embodiments, the article can be in the shape of a rod or tube. The article has uniform mechanical properties across a cross-section following cold working and has a surprising combination of high yield strength and high impact toughness prior to the final spinodal heat treatment. After spinodal heat treatment or age hardening, strength characteristics (i.e., yield strength and ultimate tensile strength) increase in keeping with known principles of precipitation hardening. A balance between strength (used for static structural engineering design) and impact toughness (used to mitigate fracture in rough service applications) is achieved by properly heat treating the large diameter article (e.g. rod or tube) in accordance with the above described process. In other words, by balancing the amount of cold work and precipitation hardening, specific target strength levels can be achieved.

In some particular embodiments, the article is a rod/tube having a uniform 0.2% offset yield strength of greater than 70,000 psi (i.e., 70 ksi) across the diameter of the rod/tube. In some further particular embodiments, the uniform 0.2% offset yield strength is from about 70 ksi to about 180 ksi across the diameter of the rod/tube. In some other particular embodiments, the uniform 0.2% offset yield strength is from about 95 ksi to about 180 ksi across the diameter of the rod/tube. The rod/tube also has a uniform impact toughness of greater than 25 foot pounds (ft-lbs) across the diameter of the rod/tube. In some particular embodiments, the uniform impact toughness is from about 25 ft-lbs to about 100 ft-lbs across the diameter of the rod/tube. The impact toughness is measured according to ASTM E23-16b with a Charpy V-notch test and at room temperature. These properties also apply to other cross-sections.

In some particular embodiments, the article is a rod/tube having a diameter of greater than 3.25 inches and a length of up to about 30 feet, a minimum 0.2% offset yield strength of about 70 ksi, and an impact toughness of about 24 ft-lbs or greater.

In some particular embodiments, the article is a rod/tube having a diameter of greater than 3.25 inches, a minimum 0.2% offset yield strength of about 95 ksi, and an impact toughness of about 25 ft-lbs to about 100 ft-lbs.

The following examples are provided to illustrate the processes of the present disclosure. The examples are merely illustrative and are not intended to limit the disclosure to the materials, conditions, or process parameters set forth therein.

EXAMPLES

Figure 2A:
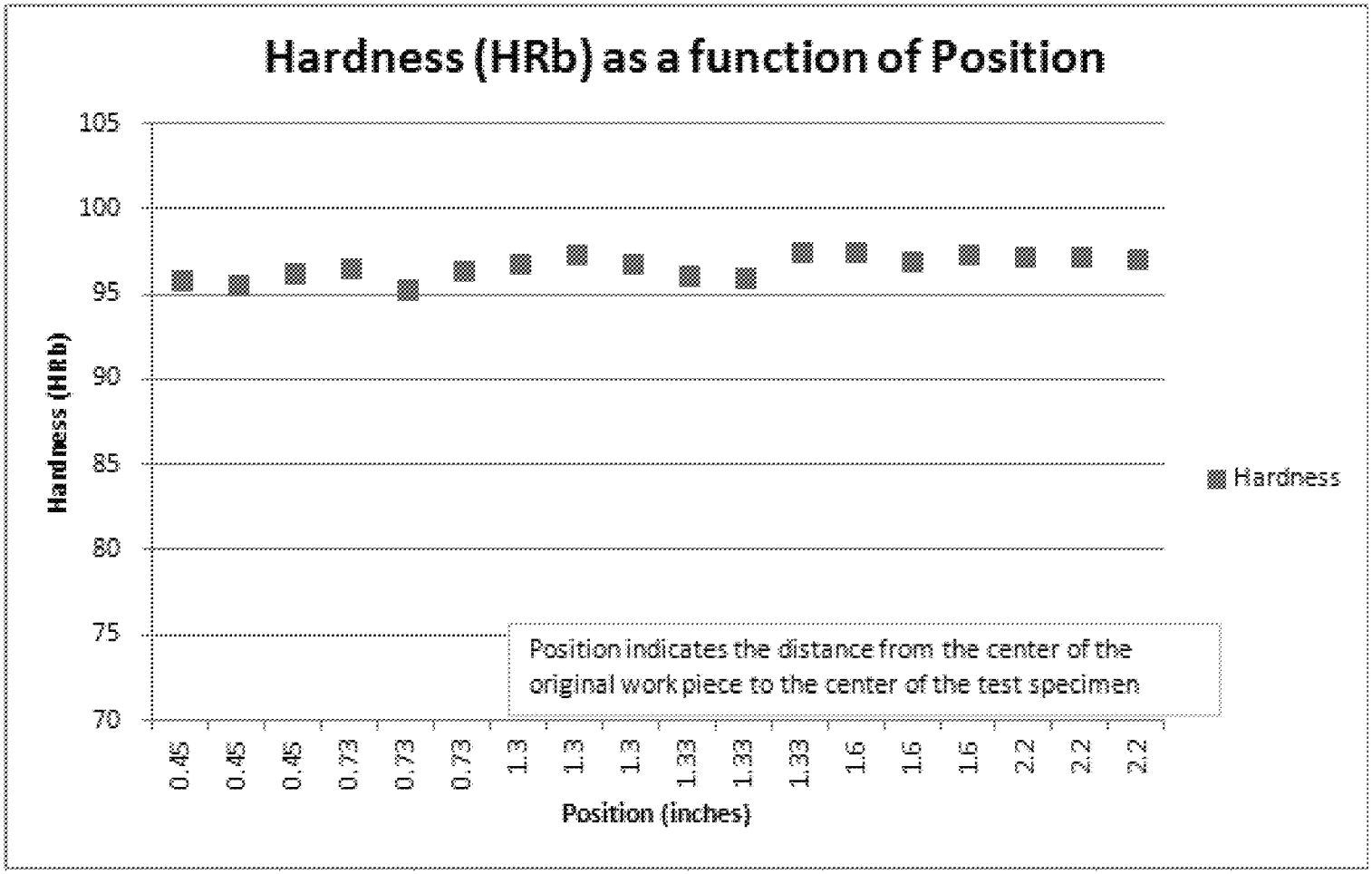
FIG. 2A is a graph showing Rockwell Hardness B (HRB) as a function of position for a metal alloy rod having a nominal diameter of 5 inches made according to the methods/processes of the present disclosure.
Figure 3A:
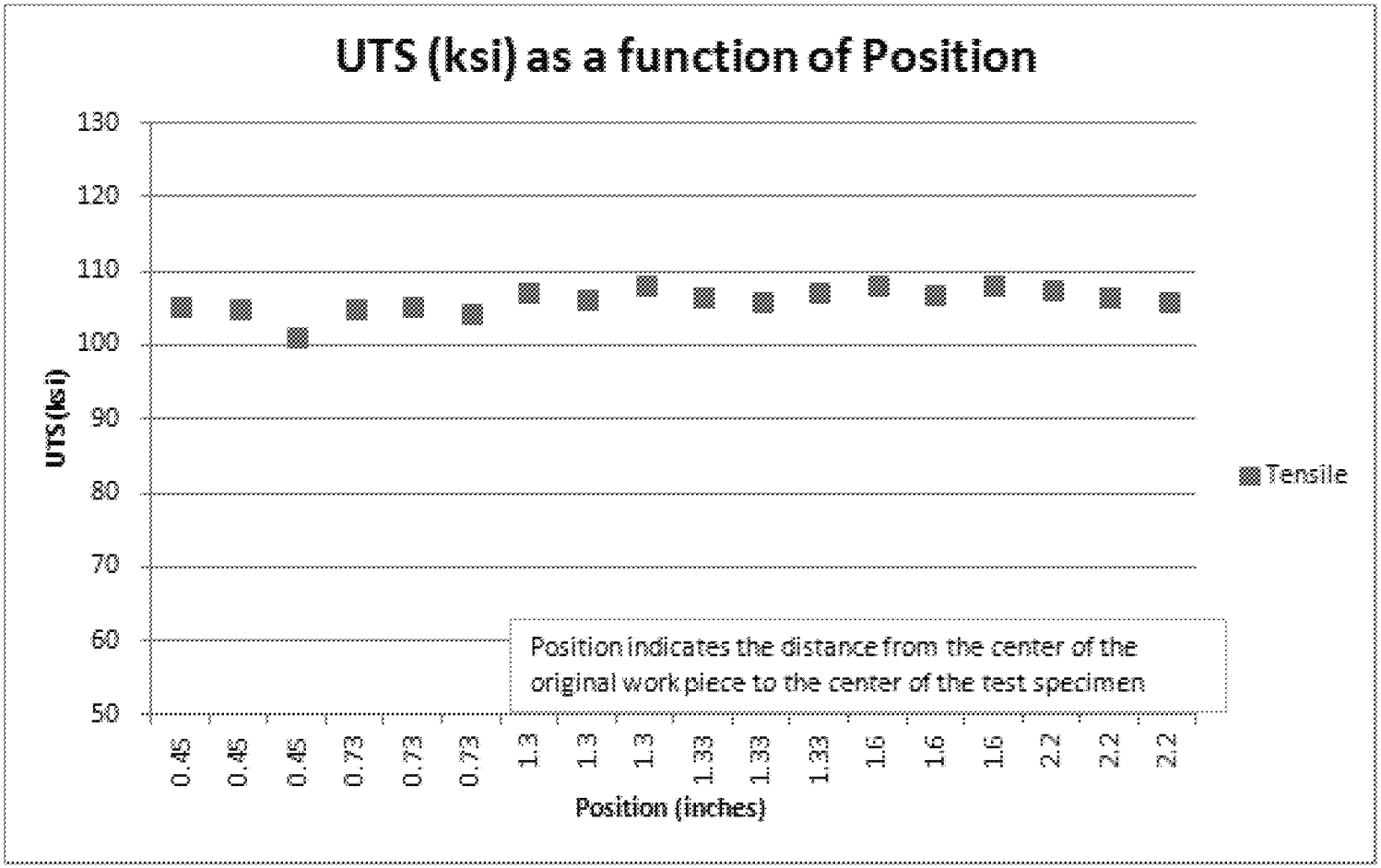
FIG. 3A is a graph showing ultimate tensile strength (UTS) as a function of position for a metal alloy rod having a nominal diameter of 5 inches made according to the methods/processes of the present disclosure.

With reference to FIG. 1A, FIG. 2A, and FIG. 3A, example property combinations achievable in a casting-derived rod with a consistent amount of cold work and heat treatment according to the processes of the present disclosure are shown. In particular, a Cu—15Ni—8Sn alloy was used for the rod, which was wrought from an original work piece. The final article was a rod having a nominal diameter of 5 inches and strengthened using the processes described above to achieve a toughness, yield strength, and ultimate tensile strength combination similar across a cross-section of the rod. Test specimens were prepared at various locations from the original work piece in order to measure the yield strength, hardness, and ultimate tensile strength as a function of position. The yield strength, tensile strength, and hardness of three test specimens were tested at six different positions. These positions were a measure of the distance from the center of the original work piece to the center of the test specimen. The positions included distances of 0.45 inches, 0.73 inches, 1.3 inches, 1.33 inches, 1.6 inches, and 2.2 inches from the center.

Figure 1B:
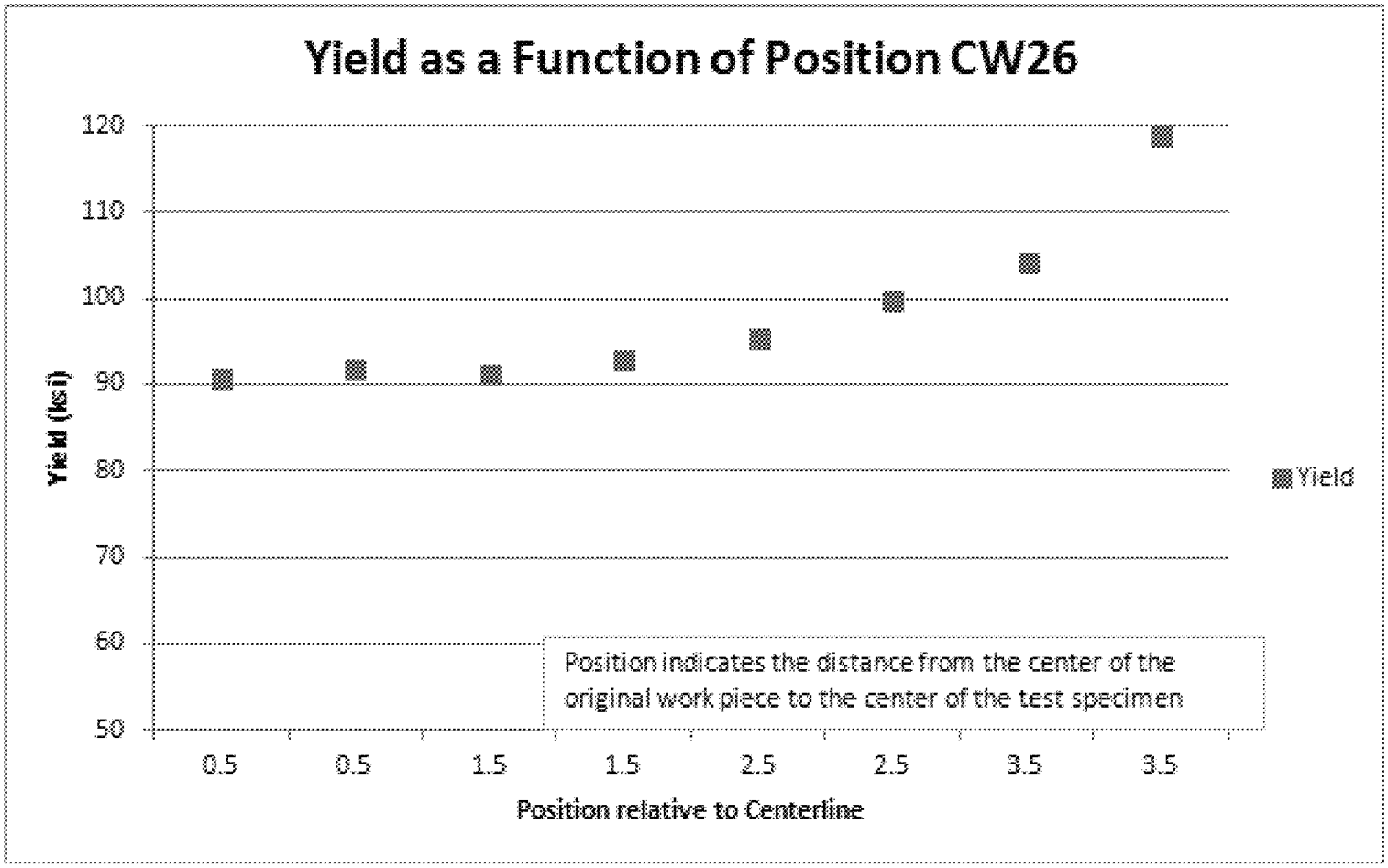
FIG. 1B is a graph showing 0.2% offset yield strength as a function of position for a metal alloy rod having a nominal diameter of 7 inches, made according to conventional processes for comparison with the graph shown in FIG. 1A.
Figure 2B:
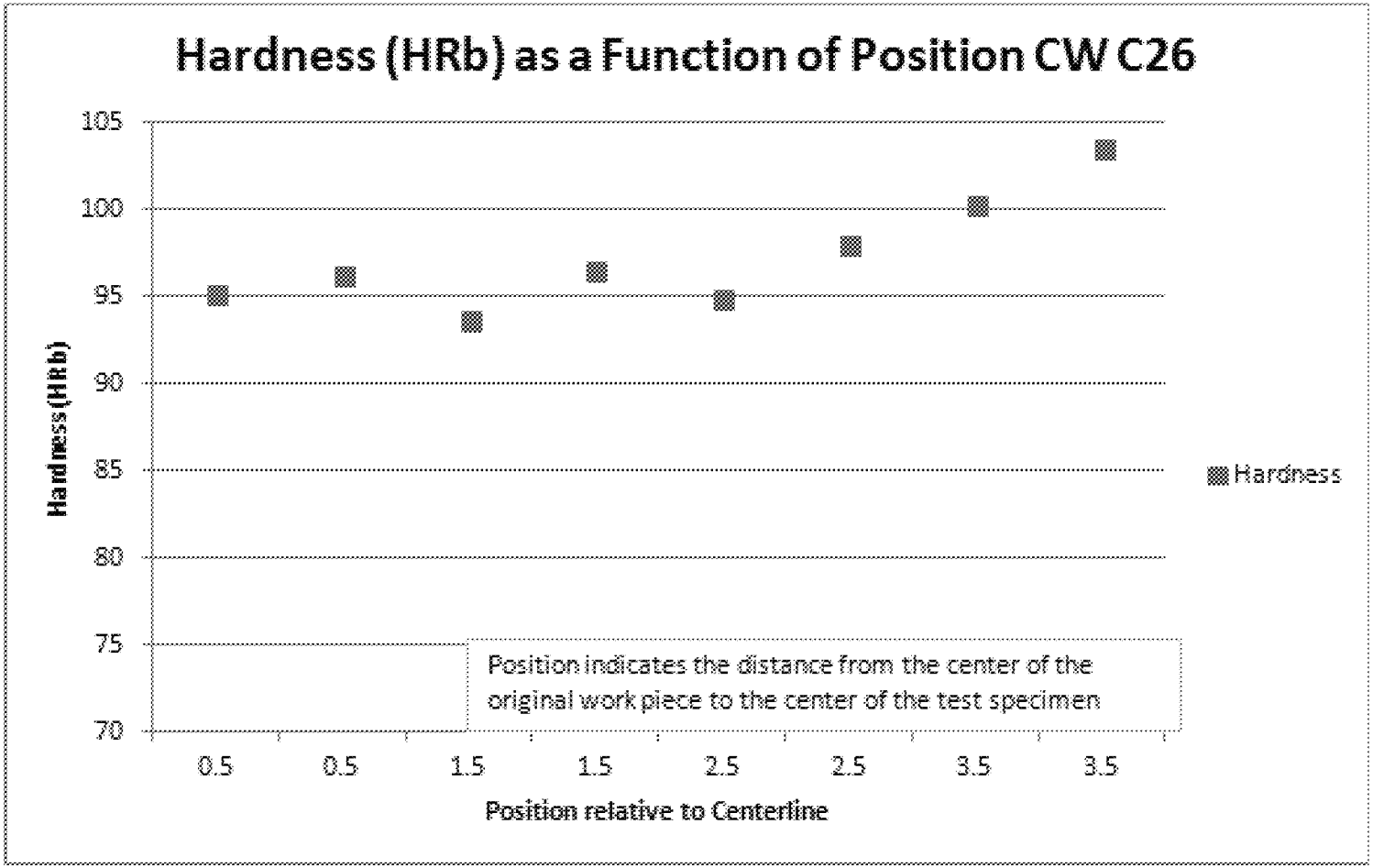
FIG. 2B is a graph showing Rockwell Hardness B as a function of position for a metal alloy rod having a nominal diameter of 7 inches, made according to conventional processes for comparison with the graph shown in FIG. 2A.
Figure 3B:
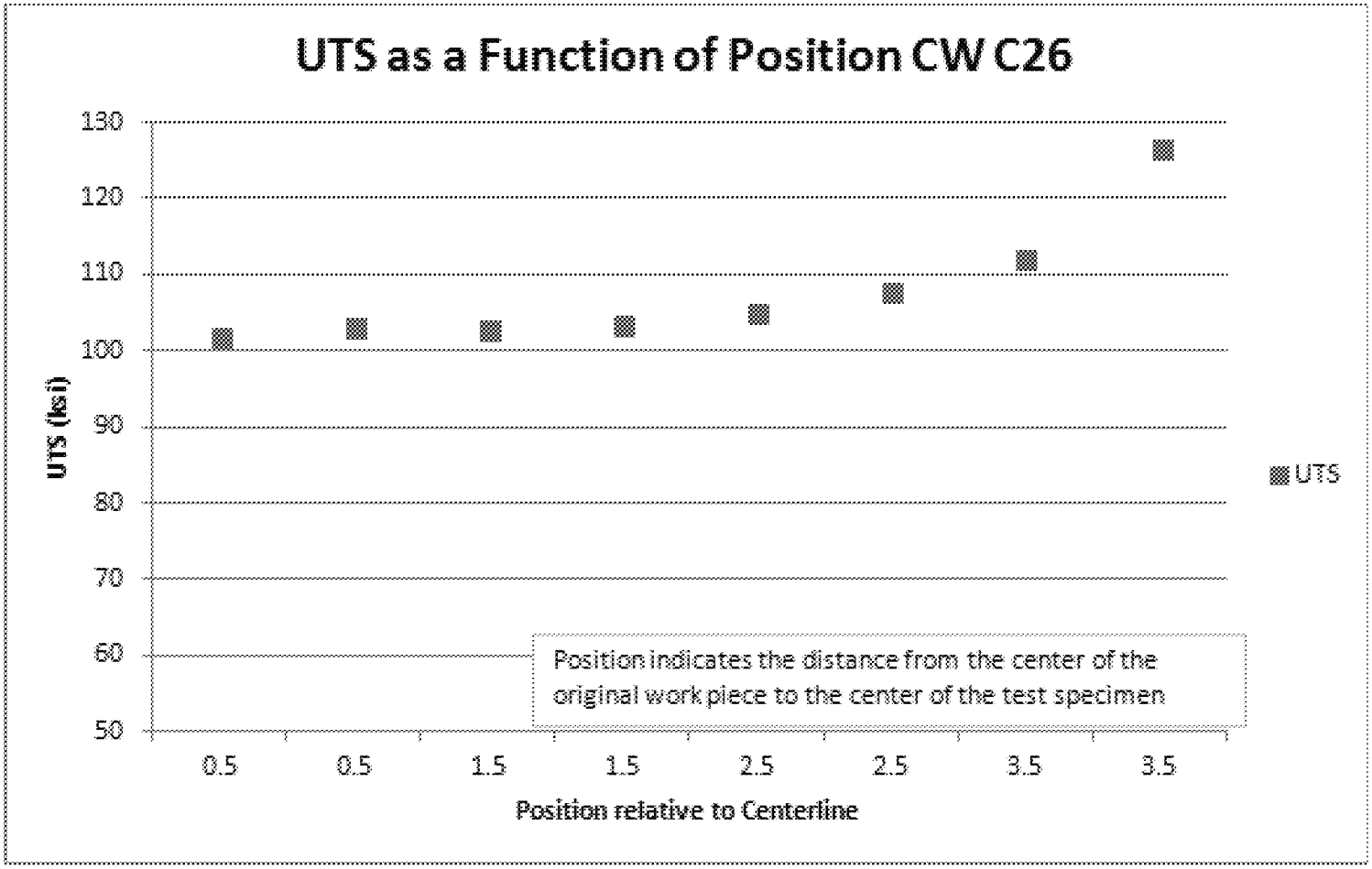
FIG. 3B is a graph showing ultimate tensile strength (UTS) as a function of position for a metal alloy rod having a nominal diameter of 7 inches, made according to conventional processes for comparison with the graph shown in FIG. 3A.

For comparison with the property combinations achievable using the strengthening processes disclosed herein and shown in FIG. 1A, FIG. 2A, and FIG. 3A, property combinations using existing strengthening processes are shown in FIG. 1B, FIG. 2B, and FIG. 3B. In particular, an existing copper-nickel-tin alloy commercially available from Materion as TOUGHMET® 3 was used for the rod. The finished article was a rod having a nominal diameter of 7 inches. Test specimens were prepared at various diameters from the article in order to measure the yield strength, hardness, and ultimate tensile strength as a function of position. The yield strength, tensile strength, and hardness of three test specimens were tested at four different positions. These positions were a measure of the distance from the center of the original work piece to the center of the test specimen. The positions included distances of 0.5 inches, 1.5 inches, 2.5 inches, and 3.5 inches from the center.

With reference to FIG. 1A, tensile testing was performed on each of the 0.45 inch, 0.73 inch, 1.3 inch, 1.33 inch, 1.6 inch, and 2.2 inch test position specimens. Yield strength was measured as the 0.2% offset. The yield strength was observed to be generally uniform for each test specimen at the varying positions. The lowest observed yield strength was about 97.5 ksi for the third test specimen at the 0.45 inch position, and the highest observed yield strength was about 106.5 ksi for the third test specimen at the 1.3 inch position. Thus, the greatest observed yield strength variation was only about 9 ksi across a section of the rod. However, yield strength generally only varied by about 2 ksi between test specimens, with an average value of about 104 ksi for all test specimens. Accordingly, the 5 inch nominal diameter finished rod exhibited uniform yield strength across its diameter, as shown in FIG. 1A. In comparison, the tensile testing of the existing copper-nickel-tin alloy, shown in FIG. 1B, shows a yield strength which varies greatly from surface (i.e., 3.5 inches) to the center of the rod (30 ksi in range).

With reference to FIG. 2A, hardness testing was performed on each of the 0.45 inch, 0.73 inch, 1.3 inch, 1.33 inch, 1.6 inch, and 2.2 inch test position specimens. In particular, the Rockwell hardness on the B scale was measured. The hardness was observed to be generally uniform for each test specimen at the varying positions, including a range of about 90 to about 100 HRB. The lowest observed hardness was about 95.3 HRB points for the second test specimen at the 0.73 inch position. The highest observed hardness was about 97.5 HRB points for the third test specimen at the 1.33 inch position and the first test specimen at the 1.6 inch position. Thus, the greatest observed hardness variation was only about 2 HRB points, which is unexpected for cold worked rod at these diameters. Accordingly, the 5 inch nominal diameter rod exhibited uniform hardness across its diameter, as shown in FIG. 2B. In comparison, the hardness testing of the existing copper-nickel-tin alloy, shown in FIG. 2B, shows a hardness which varies greatly from across the diameter of the rod (~10 HRB points in range).

With reference to FIG. 3A, ultimate tensile testing was performed on each of the 0.45 inch, 0.73 inch, 1.3 inch, 1.33 inch, 1.6 inch, and 2.2 inch test position specimens. The ultimate tensile strength was observed to be generally uniform for each test specimen at the varying positions. The lowest observed ultimate tensile strength was about 102 ksi for the third test specimen at the 0.45 inch position, and the highest observed ultimate tensile strength was about 108 ksi for the third test specimen at the 1.3 inch position. Thus, the greatest observed ultimate tensile strength variation was only about 6 ksi across a section of the rod. However, ultimate tensile strength generally only varied by about 2 ksi between test specimens. Accordingly, the 5 inch nominal diameter rod exhibited uniform ultimate tensile strength across its diameter, as shown in FIG. 3A. In comparison, the tensile testing of the existing copper-nickel-tin alloy, shown in FIG. 3B, shows an ultimate tensile strength which varies greatly from surface (i.e., 3.5 inches) to the center of the rod (30 ksi in range).

Among other applications, the articles made from the precipitation hardenable alloys disclosed herein are useful in the oil and gas exploration industry, aerospace industry, and mechanical systems and machinery using tribologic parts. In particular, the articles disclosed herein may be useful in the oil and gas exploration industry, such as drill collars, saver subs, cross-over subs, drill bit components, or centralizers. Likewise, the subject articles may be useful in the oil and gas production industry, such as Christmas trees (i.e., the assembly of valves, spools, and fittings generally used to control the flow of oil or gas out of the well), components in blow-out protection systems, sliding valve gates or bodies, components of production well pumps, or components of sucker rod pump systems. Alternatively, the articles described herein may be useful as a wear component, such as a sliding component in an industrial system. Further uses of the articles disclosed herein include as a bushing or bearing for aircraft, subsea or surface vessels, industrial machines, off-road transportation equipment, ground engaging equipment, or mining machines. Additional uses of the articles disclosed herein include non-magnetic components for exploration, sensing, or direction guidance equipment. Other uses of the subject articles may include tooling for plastic molding and manufacturing components.

By virtue of processing, including solution annealing, cold working, and precipitation hardening, large diameter (i.e., greater than 3.25 inches in diameter) copper-nickel-tin alloy rods or tubes with a minimum 0.2% offset yield strength of 70 ksi up to 180 ksi and a Charpy impact energy as high as 25 ft-lbs and up to 100 ft-lbs are now possible. These advantageous mechanical properties can be further achieved in articles having a relatively constant cross-section along the length of the article. The solution annealing, cold working, and precipitation hardening processing permit these advantageous mechanical properties to be uniform across the cross-sectional area of the articles disclosed herein. These are characteristics of key importance in severe mechanical service applications where high resistance to crack initiation and propagation, fatigue resistance, long life and reliability, galling resistance, wear resistance, abrasion resistance, temperature resistance, etc., are desired.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. An article, comprising:

a precipitation hardened copper-nickel-tin alloy; and having a constant cross-section along a length of the article, wherein the article has a uniform 0.2% offset yield strength and a uniform hardness across the cross-section of the article.

2. The article of claim 1, wherein the article is a rod or tube.

3. The article of claim 2, wherein the rod or tube has a diameter of at least 3.25 inches, or a diameter of about 5 inches, or a diameter of about 10 inches.

4. The article of claim 2, wherein the rod or tube has a length of up to about 30 feet or more.

5. The article of claim 1, wherein the copper-nickel-tin alloy comprises from about 5 wt % to about 20 wt % nickel, from about 5 wt % to about 10 wt % tin, and the balance copper; or wherein the copper-nickel-tin alloy comprises from about 14 wt % to about 16 wt % nickel, from about 7 wt % to about 9 wt % tin, and the balance copper; or wherein the copper-nickel-tin alloy comprises from about 8 wt % to about 10 wt % nickel, from about 5 wt % to about 7 wt % tin, and the balance copper.

6. The article of claim 1, wherein the article has a uniform Charpy V-notch impact toughness of from about 25 ft-lbs to about 100 ft-lbs.

7. The article of claim 1, wherein the uniform 0.2% offset yield strength of the article is from about 70 ksi to about 180 ksi.

8. The article of claim 1, wherein the article has a uniform Rockwell B hardness from about HRB 90 to about HRB 100 or a uniform Rockwell C hardness of about HRC 20 to about HRC 40.

9. The article of claim 1, wherein the article is a drill collar; a saver sub; a cross-over sub; a drill bit component; a centralizer; a Christmas tree; a component of a blow-out protection system; a sliding valve gate or body; a component of a production well pump; a component of a sucker rod pump system; a sliding component in an industrial system;

a bushing or a bearing for an aircraft, a subsea or surface vessel, an industrial machine, off-road transportation and ground engaging equipment, a mining machine; a non-magnetic component for exploration, sensing, or directional guidance equipment; or is a tooling component for a plastic molding, welding, or manufacturing device.

10. The article of claim 1, wherein the metal alloy is an aluminum, copper, nickel, iron, or titanium alloy.

11. A device that includes the article of claim 1.

* * * * *